US008661772B2

(12) United States Patent
Yasuhira

(10) Patent No.: US 8,661,772 B2
(45) Date of Patent: Mar. 4, 2014

(54) METHOD FOR SEALING-IN A GAS IN A BAG WITH A GAS FILLING COMPARTMENT

(71) Applicant: Masanori Yasuhira, Iwakuni (JP)

(72) Inventor: Masanori Yasuhira, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 0 days.

(21) Appl. No.: 13/675,876

(22) Filed: Nov. 13, 2012

(65) Prior Publication Data

US 2013/0167481 A1 Jul. 4, 2013

Related U.S. Application Data

(62) Division of application No. 11/585,727, filed on Oct. 24, 2006, now abandoned.

(30) Foreign Application Priority Data

Oct. 25, 2005 (JP) ..... 2005-310525

(51) Int. Cl.
*B65B 55/20* (2006.01)
*B65B 31/04* (2006.01)
*B65D 81/03* (2006.01)

(52) U.S. Cl.
USPC ..... 53/403; 53/469; 53/79; 53/284.7; 383/3; 206/522

(58) Field of Classification Search
CPC .... B65B 55/20; B65B 31/046; B65B 31/048; B65B 43/465; B65D 81/03; B31D 5/0073
USPC ..... 53/403, 434, 469, 472, 79, 139.5, 512, 53/284.7; 206/522; 383/3, 109
IPC ..... B65B 55/20; B65D 81/03
See application file for complete search history.

(56) References Cited

U.S. PATENT DOCUMENTS

| | | | | |
|---|---|---|---|---|
| 3,340,669 A | | 9/1967 | Farquharson | |
| 3,376,690 A | * | 4/1968 | Jianas | 53/512 |
| 3,382,642 A | * | 5/1968 | Shaw | 53/434 |
| 3,745,024 A | * | 7/1973 | Ford et al. | 53/434 |
| 3,938,298 A | * | 2/1976 | Luhman et al. | 53/403 |

(Continued)

FOREIGN PATENT DOCUMENTS

| | | |
|---|---|---|
| DE | 88 11 162.8 | 12/1988 |
| EP | 0 306 207 | 3/1989 |

(Continued)

*Primary Examiner* — Stephen F Gerrity
(74) *Attorney, Agent, or Firm* — DLA Piper LLP (US)

(57) ABSTRACT

A method for sealing-in a gas in a bag that has therein a gas filling compartment, including the steps of: placing a blow-out port of a nozzle, which is connected to a pressurized gas supply source, against a cut-in or a hole of the bag and holding the back surface side of the bag with a backing member; blowing a gas from the nozzle into the gas filling compartment of the bag through the cut-in or the hole; gripping and thus closing the gas flow path in sealed portions surrounding the periphery of the cut-in or the hole by a blocking gripper while the gas blow-in continues, thus cutting off the flow of the gas between the cut-in or the hole and the inside of the gas filling compartment; and then sealing the cut-in or the hole, thus allowing the gas to be sealed in the gas filling compartment.

15 Claims, 11 Drawing Sheets

(56) References Cited

U.S. PATENT DOCUMENTS

| | | | | | |
|---|---|---|---|---|---|
| 4,190,158 | A | * | 2/1980 | Ambrose | 206/522 |
| 4,465,188 | A | * | 8/1984 | Soroka et al. | 206/522 |
| 4,534,154 | A | * | 8/1985 | Gaubert | 53/434 |
| 4,551,379 | A | | 11/1985 | Kerr | |
| 4,727,706 | A | | 3/1988 | Beer | |
| 4,872,558 | A | * | 10/1989 | Pharo | 206/522 |
| 4,877,334 | A | | 10/1989 | Cope | |
| 4,949,529 | A | | 8/1990 | Davis | |
| 5,009,318 | A | | 4/1991 | Lepinoy | |
| 5,272,856 | A | * | 12/1993 | Pharo | 53/472 |
| 5,427,830 | A | | 6/1995 | Pharo | |
| 5,447,235 | A | | 9/1995 | Pharo | |
| 5,454,642 | A | | 10/1995 | De Luca | |
| 5,487,470 | A | | 1/1996 | Pharo | |
| 5,826,723 | A | | 10/1998 | Jaszai | |
| 5,830,780 | A | | 11/1998 | Dennison et al. | |
| 6,116,000 | A | | 9/2000 | Perkins et al. | |
| 6,276,532 | B1 | | 8/2001 | Sperry et al. | |
| 6,283,296 | B1 | | 9/2001 | Newman | |
| 6,569,283 | B1 | | 5/2003 | Sperry et al. | |
| 6,722,502 | B1 | | 4/2004 | Newman | |
| 6,913,803 | B2 | | 7/2005 | Peper | |
| 6,978,893 | B2 | | 12/2005 | Peper | |
| 7,444,795 | B2 | * | 11/2008 | Yasuhira | 53/403 |
| 2003/0139271 | A1 | * | 7/2003 | Vangedal-Nielsen et al. | 493/162 |
| 2005/0077004 | A1 | * | 4/2005 | Borgeat | 156/285 |
| 2006/0272288 | A1 | * | 12/2006 | Kannankeril | 53/403 |
| 2008/0035519 | A1 | | 2/2008 | Swartz et al. | |
| 2009/0249745 | A1 | * | 10/2009 | Forss | 53/79 |

FOREIGN PATENT DOCUMENTS

| | | | | | |
|---|---|---|---|---|---|
| JP | 64-2745 | | | 1/1989 | |
| JP | 64-084869 | | | 3/1989 | |
| JP | 02-098563 | | | 4/1990 | |
| JP | 03-069477 | | | 3/1991 | |
| JP | 04114880 | A | * | 4/1992 | B65D 81/00 |
| JP | 06211251 | A | * | 8/1994 | B65D 30/08 |
| JP | 06278703 | A | * | 10/1994 | B65B 3/17 |
| JP | 07165266 | A | * | 6/1995 | B65D 81/07 |
| JP | 07291230 | A | * | 11/1995 | B65B 43/30 |
| JP | 8-1398 | | | 9/1996 | |
| JP | 09-132213 | | | 5/1997 | |
| JP | 10-329869 | | | 12/1998 | |
| JP | 10316148 | A | * | 12/1998 | B65D 30/08 |
| JP | 2002347846 | A | * | 12/2002 | B65D 81/07 |
| JP | 2004051192 | A | * | 2/2004 | B65D 81/02 |

* cited by examiner

METHOD FOR SEALING-IN A GAS IN A BAG WITH A GAS FILLING COMPARTMENT

CROSS-REFERNECE TO REALTED APPLICATIONS

This is a division of U.S. patent application Ser. No. 11/585,727, filed Oct. 24, 2006, now abandoned, which is incorporated herein in its entirety by reference.

BACKGROUND OF THE INVENTION

1. Field of the Invention

The present invention relates to a bag with a gas filling compartment made of an inner bag and an outer bag having a gas filled in between the inner bag and the outer bag to protect the contents packaged inside the inner bag from shock or the like and also relates to a manufacturing method of such a bag and further to a gas filling method in such a bag and a packaging method for such a bag.

2. Description of the Related Art

Bag with a gas filling compartment (or with an air bag) comprising an outer bag and an inner bag that is provided inside the outer bag, made so that a gas is filled in between the inner bag and the outer bag, are commonly known and disclosed in, for instance, Japanese Utility Model Application Laid-Open (Kokai) Nos. 64-2745 and 8-1398; Japanese Patent Application Laid-Open (Kokai) Nos. 64-84869, 2-98563 and 9-132213; and Japanese Patent Nos. 2800034 and 3015323

However, conventional bag with a gas filling compartment does not have a structure suitable for automating the process of sealing gas into the bas filling spaces or for automating the entire packaging process including such a gas sealing process, and the gas sealing process disclosed in, for instance, Japanese Utility Model Application Laid-Open (Kokai) 8-1398 is also not suitable for being automated.

SUMMARY OF THE INVENTION

Accordingly, it is an object of the present invention, which is devised in view of the points noted above, to provide a bag with a gas filling compartment (or with an air bag) that has a structure suitable for automating the process of sealing gas into the gas filling compartment and for automating the entire packaging process inclusive of that sealing process.

It is another object of the present invention to provide a gas sealing method suitable for being automated and to provide a packaging method that uses the gas sealing method.

The above objects are accomplished by a unique structure of the present invention for a bag that has a gas filling compartment and is made of an outer bag and an inner bag which is provided inside of and is substantially equal in width to the outer bag; and in this bag:

- the inner bag has an opening along an upper edge thereof;
- films of the inner bag and films of the outer bag are sealed together, on each side of respective bags, along upper edges thereof, and further both lateral side edges and lower edges of the films of the inner bag and the films of the outer bag are sealed together, thus forming gas filling compartments between the films of the inner bag and the films of the outer bag;
- means for introducing gas in the gas filling compartments are formed in the respective films of the outer bag; and
- the films of the outer bag and the films of the inner bag are sealed together in the vicinity of the means for introducing gas, and sealed portions thereof surround peripheries of the means for introducing gas, leaving gas flow paths communicating to insides of the gas filling compartments.

In the above-described bag of the present invention, it is preferable that the above-described means for introducing gas (cut-ins or holes) be formed either in the vicinity of the upper edge sides or in the vicinity of the lateral side edges of the films of the outer bag, and it is particularly preferable that they be formed in the vicinity of the upper edge side corners on mutually opposite sides.

In a desirable form for the sealed portion surrounding the periphery of the above-described means for introducing gas (cut-ins or holes):

- a supplemental sealed portion is formed by sealing a part of the films of the outer bag and a part of the films of the inner bag; and
- the supplemental sealed portion and an upper edge sealed portion and/or one of lateral side edge sealed portions form the above-described sealed portions that surround the periphery of said means for introducing gas.

In this structure, it is preferable that the supplemental sealed portion be formed so as to be continuous to the upper edge sealed portion and/or one of the lateral side edge sealed portions.

The above objects are accomplished by unique steps of the present invention for a method for manufacturing a bag with a gas filling compartment, and the unique steps of the present invention includes:

- unwinding and paying out, from two rolls on each of which tube film is wound, tube films folded together in a two-ply stacked condition;
- forming, for each of the folded-together tube films, a means for introducing gas (which is a cut-in or a hole) in films that are to be made into the films of the outer bag;
- sealing, for each of the tube films, films that are to be the films of the outer bag and films that are to be the films of the inner bag films, together, thus forming an upper edge sealed portion and a supplemental sealed portion;
- stacking the two tube films together; then
- sealing the two tube films together to form two lateral side edge sealed portions and the lower edge sealed portion, thus producing a bag with a gas filling compartment; and then
- cutting the bag with a gas filling compartment away from the end of the films.

The above objects are accomplished by unique steps of the present invention for a method for manufacturing a bag with a gas filling compartment, and the unique steps of the present invention includes:

- unwinding and paying out films from two rolls on each of which film is wound;
- folding the unwound and paid out films double in a longitudinal direction thereof;
- forming, for each of the double-folded films, means for introducing gas (which is a cut-in or a hole) in films that are to be made into the films of the outer bag;
- sealing together, for each of the double-folded films, one side thereof that is to be the films of the outer bag and one side thereof that is to be the films of the inner bag, thus forming an upper edge sealed portion and a supplemental sealed portion;
- stacking together two double-folded films;
- sealing together the two double-folded films to form lateral side edge sealed portions and lower edge sealed portion, thus producing a bag with a gas filling compartment; and then cutting the bag with a gas filling compartment away from the end of the films.

The above objects are accomplished by unique steps of the present invention for a method for manufacturing a bag with a gas filling compartment, and the unique steps of the present invention includes:

unwinding and paying out films from two rolls on each of which film is wound;

forming a means for introducing gas (which is a cut-in or a hole) at two locations in one of unwound and paid-out two films;

stacking together the two films;

folding the two films double in the longitudinal direction thereof so that the one film is on the outer side and another film is on an inner side, thus making a four-ply stack;

sealing together, on the opening side of the four-ply stacked films, the outer surface film and the inner surface film on each side of the respective four-ply stacked films;

then sealing together the four-ply stacked films to form two lateral side edge sealed portions and a lower edge sealed portion, thus producing a bag with a gas filling compartment; and then cutting the bag with a gas filling compartment away from the end of the films.

In the above method, it is also possible to:

stack together the two films; then seal together the two films to form an upper edge sealed portion and a supplemental sealed portion at two locations; and then folding the two films double in a longitudinal direction thereof to make a four-ply stack.

The above objects are accomplished by another unique structure of the present invention for a bag that has a gas filling compartment and is made of an outer bag and an inner bag which is provided inside of and is smaller in width than the outer bag; and in this bag:

the inner bag has an opening along an upper edge thereof;

films of the inner bag and films of the outer bag are sealed together, on each side of respective bags, along upper edges thereof, the films of the inner bag and the films of the outer bags are sealed together along lower edges thereof, and further the films of the outer bag are sealed together at upper and lower edges thereof on both lateral sides of the inner bag and along both lateral side edges thereof, thus forming a gas filling compartment between the films of the inner bag and outer bag;

a means for introducing gas is formed in at least one side of the outer bag; and the films of the outer bag are sealed together in the vicinity of the means for introducing gas, and sealed portions thereof surround a periphery of the means for introducing gas, leaving a gas flow path communicating to inside of the gas filling compartment.

In the above structure, it is preferable that the above-described means for introducing gas (cut-ins or holes) be formed in the vicinity of the upper edge sides or in the vicinity of the lateral side edge sides, and it is more preferable that they be formed in the vicinity of the upper edge side corners.

In a desirable form for the sealed portion enclosing the periphery of the above-described means for introducing gas (cut-ins or holes):

a supplemental sealed portion is formed by sealing a part of the films of the outer bag; and the supplemental sealed portion and one of upper edge sealed portions formed by films of the outer bag and/or one of lateral side edge sealed portions of the outer bag form the above-described sealed portions that surround the periphery of said means for introducing gas.

In this structure, it is preferable that the supplemental sealed portions are formed so as to be continuous to the upper edge sealed portions or one of the lateral side edge sealed portions.

The above objects are further accomplished by unique steps of the present invention for method for sealing-in a gas in a bag with a gas filling compartment, and the present invention takes take the steps of:

placing the blow-out port of a nozzle, which is connected to a pressurized gas supply source, against a means for introducing gas (cut-ins or holes) and holding the back surface side of the bag with a backing member;

blowing a gas from the nozzle into the inside of the gas filling compartment through the means for introducing gas;

gripping and thus closing the gas flow path in the sealed portions surrounding the periphery of the means for introducing gas by a blocking gripper while the gas blow-in continues, thus cutting off the flow of gas between the means for introducing gas and the inside of the gas filling compartment; and sealing the means for introducing gas, thus allowing the gas to be sealed in the gas filling compartment.

In the above steps of the present invention, the sealing of the means for introducing gas (cut-ins or holes) is effected by sealing two surfaces of the bag at the location of the means for introducing gas. In cases where the cut-ins or holes are formed in the vicinity of the upper edge side corner, when the bag mouth is sealed from both surfaces at the end of the packaging process, the cut-ins or holes can be sealed at the same time as the sealing of the bag mouth, and it is preferable that that be done in that way.

The above objects are further accomplished by unique steps of the present invention for a method for packaging a bag having a gas filling compartment; and in the present invention, the method uses, for instance, a commonly known rotary type packaging apparatus and endless track type packaging apparatus in which bags, held at both lateral side edges thereof by grippers and suspended, are continuously or intermittently conveyed, and, during the course of the conveyance, various packaging processes including bag mouth opening, filling the bag with contents to be packaged, and bag mouth sealing are successively performed; and further, in the present invention, the process for sealing gas in the gas filling compartment of the bag is executed after the process for filling the inner bag with contents to be packaged; and the process for sealing gas includes the steps of:

placing the blow-out port of a nozzle, which is connected to a pressurized gas supply source, against a means for introducing gas (which is a cut-in or a hole) and holding the back surface side of the bag with a backing member;

blowing a gas from the nozzle into the inside of the gas filling compartment through the means for introducing gas;

gripping and closing the gas flow path in the sealed portions surrounding the periphery of the means for introducing gas by a blocking gripper while the gas blow-in continues, thus cutting off the flow of gas between the means for introducing gas and the inside of the gas filling compartment; and sealing bag mouth of the bag from both surfaces and at the same time the means for introducing gas is sealed therewith, thus sealing the gas inside the gas filling compartment.

With the use, using also a bag with a gas filling compartment made by the present invention, of the above-described gas seal-in method of the present invention, the process of sealing gas into a gas filling compartment (or an air bag), which has been done almost entirely manually, and the entire packaging process, which includes gas seal-in process, can be performed automatically and performed efficiently.

DETAILED DESCRIPTION OF THE INVENTION

The present invention will now be described specifically with reference to FIGS. 1(*a*) to 11(*c*).

Figure 1B:
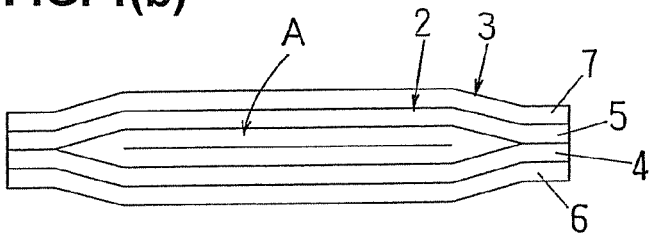
FIG. 1(*a*) is a schematic front elevational view of a bag with a gas filling compartment according to the present invention, FIG. 1(*b*) being a top view thereof, and FIG. 1(*c*) being a sectional view thereof.
Figure 1A:
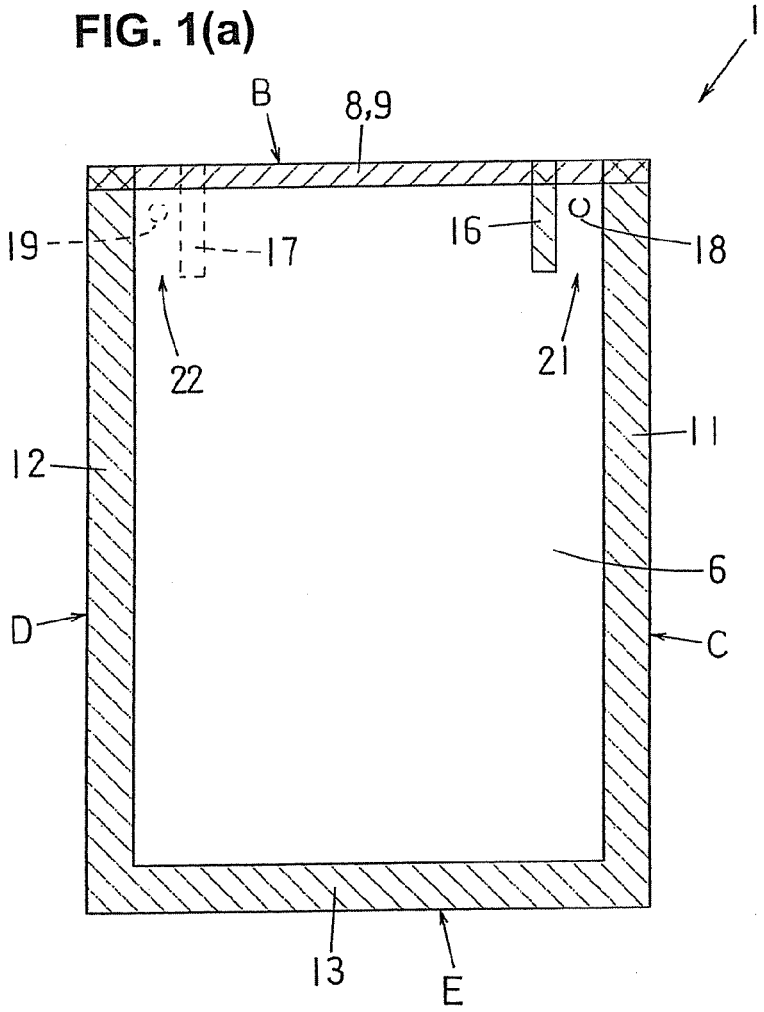
Figure 1C:
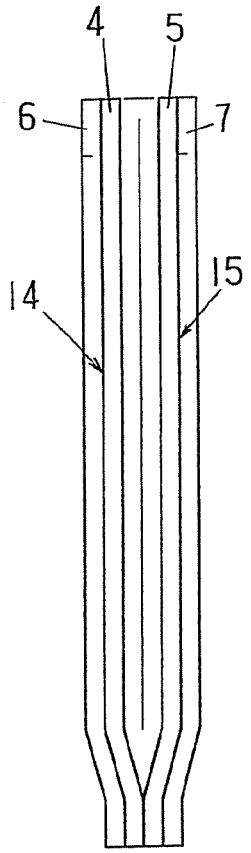

In FIGS. 1(*a*) through 1(*c*), a bag with a gas filling compartment 1 is shown. The bag 1 comprises an inner bag 2 and an outer bag 3 of the substantially same width, the bag mouth (opening) A of the inner bag 2 is open.

The films 4 and 5 of the inner bag 2 and films 6 and 7 of the outer bag 3 are sealed together along the upper edges thereof on each side of the respective bags (in other words, the adjacent film 4 of the inner bag 2 and film 6 of the outer bag 3 both on one side are sealed together to form a sealed portion 8, and the adjacent film 5 of the inner bag 2 and film 7 of the outer bag 3 both on another side are sealed together to form a sealed portion 9), along the upper edge B of the bag 1. These sealed portions 8 and 9 are indicated by crosshatching in FIG. 1(*a*).

Along the two lateral side edges C and D and lower edge E of the bag 1, moreover, the films 4 and 5 of the inner bag 2 and the films 6 and 7 of the outer bag 3 are sealed together. These lateral side edge sealed portions 11 and 12 to and the lower edge sealed portion 13 are indicated similarly by crosshatching in FIG. 1(*a*).

By these sealed portions 8, 9, and 11 to 13, as seen from FIG. 1(*c*), a gas filling compartment (air bag) 14 is formed between the film 4 of the inner bag 2 and the film 6 of the outer bag 3 and a gas filling compartment (air bag) 15 is formed between the film 5 of the inner bag 2 and the film 7 of the outer bag 3. In FIG. 1(*c*), the gas filling compartments 14 and 15 are not distended; accordingly, the bag is shown with no gaps between the films 4 and 6 or between the films 5 and 7.

In the vicinity of the upper edge side corner of the bag 1, a supplemental sealed portion 16 is formed, to be connected to the sealed portion 8, of a prescribed length in the longitudinal direction, wherein, as in the sealed portion 8, a part of the film 4 of the inner bag 2 and a part of the film 6 of the outer bag 3 are sealed together; and further, in the vicinity of the upper edge corner on the opposite side, a supplemental sealed portion 17 is formed, to be connected to the sealed portion 9, in the longitudinal direction, wherein, as in the sealed portion 9, a part of the film 5 of the inner bag 2 and a part of the film 7 of the outer bag 3 are sealed together. The reason why the expression "supplemental" sealed portion 16 and 17 is used here is that, as will be described further below, these sealed portions 16 and 17 are necessary, in a supplementary way, upon charging gas into the gas filling compartments 14 and 15. Furthermore, in the supplemental sealed portion 16, only a part of the film 4 of the inner bag 2 and a part of the film 6 of the outer bag 3 are sealed, while, in the supplemental sealed portion 17, a part of only the film 5 of the inner bag 2 and the film 7 of the outer bag 3 are sealed; however, the functions of the auxiliary seals can be effected even if respective parts of all of the films 4 to 7 in the inner bag 2 and outer bag 3 are sealed, in the two supplemental sealed portions 16 and 17. In that case, however, the interior of the inner bag 2 would become substantially narrower.

Furthermore, at places even closer to the corners than the sealed portions 8 and 9, circular arc-shaped cut-ins 18 and 19 for gas blow-in (the cut-ins thus forming a means for introducing a gas into the gas filling compartments) are formed, respectively, in the surfaces of the films 6 and 7 in the outer bag 3. The cut-in 18 has its vicinity surrounded, above by the sealed portion 8, to the inside in the width direction by the supplemental sealed portion 16, and to the outside in the width direction by the sealed portion 11 (at which sealed portion 11, the film 4 of the inner bag 2 and the film 6 of the outer bag 3 are of course sealed together); while the cut-in 19 has its vicinity surrounded, above by the sealed portion 9, to the inside in the width direction by the supplemental sealed portion 17, and to the outside in the width direction by the sealed portion 12 (at which sealed portion 12, the film 5 of the inner bag 2 and the film 7 of the outer bag 3 are of course sealed together); thus leaving an unsealed part only below, respectively, that is, leaving and forming gas flow paths 21 and 22 that communicate with the inside of the gas filling compartments 14 and 15. Accordingly, gas blown into the bag 1 from the cut-ins 18 and 19 enters into the gas filling compartments 14 and 15 through the gas flow paths 21 and 22.

Figures 2A, 2B:
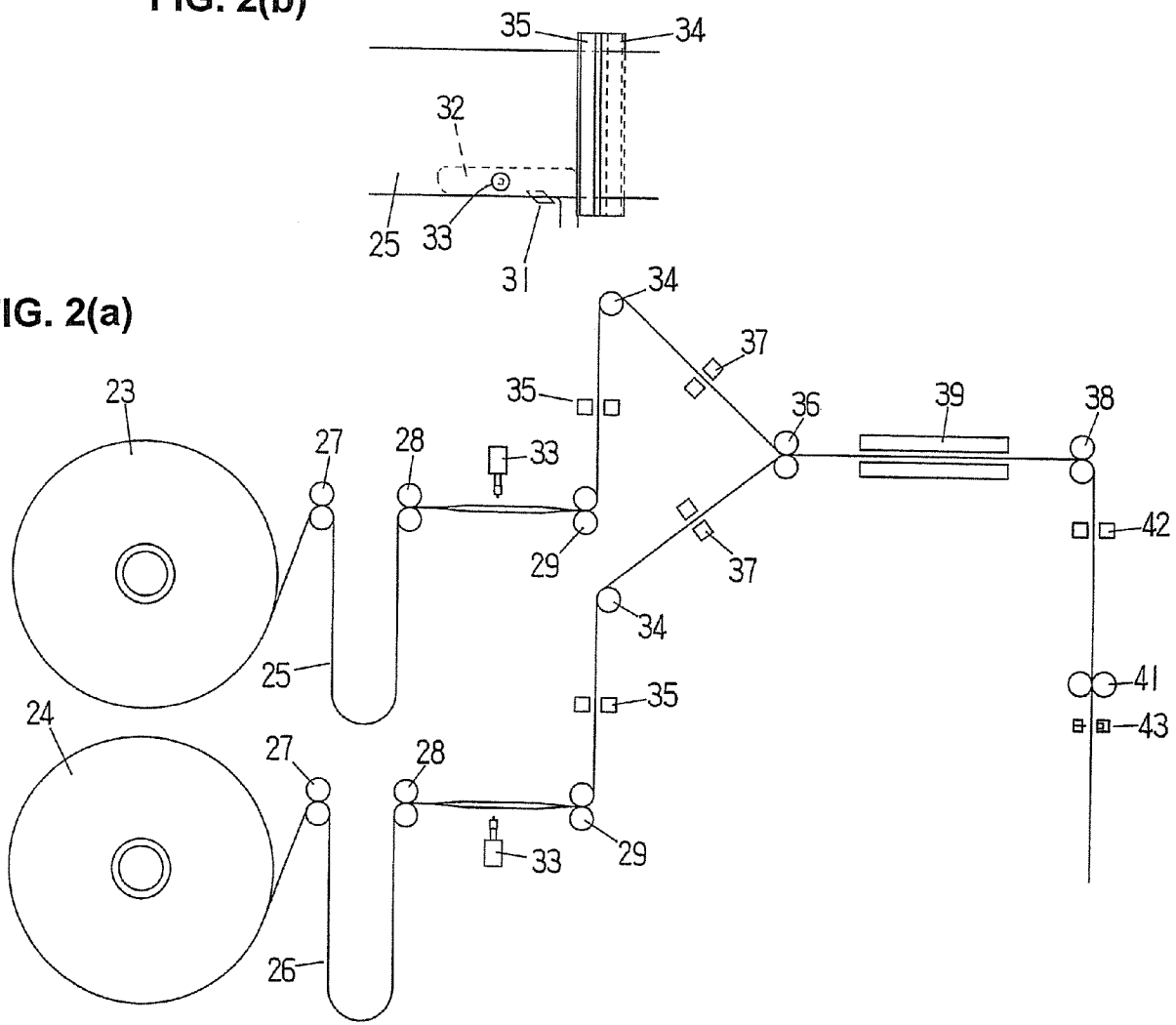
FIG. 2(*a*) is a schematic side elevational view of the overall manufacturing method of the bag with a gas filling compartment, and FIG. 2(*b*) being a top view of a part thereof.

An example of the manufacturing method of the bag 1 will be shown in FIGS. 2(*a*) and 2(*b*).

On two source rolls 23 and 24 are wound tubular films 25 and 26, respectively, folded in a two-ply stacked condition (in a condition wherein they are mashed flat). The tubular films 25 and 26, in the folded condition, are paid out continuously by feed rollers 27 and, from guide rollers 28 on, are conveyed intermittently, one bag-length at a time, and are successively subjected to such operations as the following:

(1) Cut-ins 18 and 19 are formed in the surfaces that become the films 6 and 7 of the outer bag 3. On the tubular film 25 side, between the guide rollers 28 and 29, a backing member 32 (see FIG. 2(*b*)) equipped with a cutter 31 is, from the downstream side of the cutter 31, inserted and positioned between the upper and lower films, so that a punch 33 installed above advances and retracts relative to that backing member 32, thus forming the cut-in 18. On the tubular film 26 side, the same operation is performed with inverted (up-down) symmetry, and the cut-in 19 is formed.

(2) The surfaces that are to become the films of the inner bag 2 and the surfaces that are to become the films of the outer bag 3 are sealed, and the sealed portions 8 and 9 and formed. On the tubular film 25 side, a sealing mechanism (indicated only by a pair of hot plates 35) is set between the guide rollers 29 and 34, where the films are held between the hot plates 35, and the sealed portion 8 is formed. On the tubular film 26 side also, the same operation is performed, and the sealed portion 9 is formed.

(3) The surfaces that are to become the films of the inner bag 2 and the surfaces that are to become the films of the outer bag 3 are sealed, and the supplemental sealed portions 16 and 17 are formed. On the tubular film 25 side, a sealing mechanism (indicated only by a pair of hot plates 37) is set between the guide rollers 34 and 36, where the films are held between the hot plates 37, and the sealed portion 16 is formed. On the tubular film 26 side also, the same operation is performed, and the sealed portion 17 is formed.

(4) The tubular films 25 and 26 are stacked together.

(5) The tubular films 25 and 26 are sealed and the sealed portions 11 and 12 are formed. A sealing mechanism (indicated only by a pair of hot plates 39) is set between the guide rollers 36 and 38, where the films are held by the hot plates 39.

(6) The tubular films 25 and 26 are sealed and the sealed portion 13 is formed. A sealing mechanism (indicated only by a pair of hot plates 42) is set between the guide rollers 38 and feed rollers 41, where the films are held by the hot plates 42.

(7) The formed bag with a gas filling compartment 1 is cut away from the ends of the tubular films 25 and 26. A cutter device 43 is set beyond the feed rollers 41.

In the embodiment described above, the supplemental sealed portions 16 and 17 are formed after the sealed portions 8 and 9 are formed, but this order may be reversed; and the sealed portions 8 and 9 and supplemental sealed portions 16 and 17 can also be formed in a one-time operation. Also, the sealed portion 13 is formed after the sealed portions 11 and 12 are formed, but this order may be reversed, and the sealed portions 11 to 13 can also be formed in a one-time operation. The important thing is that the sealed portions 8 and 9 and the supplemental sealed portions 16 and 17 are formed before the tubular films 25 and 26 are stacked together, and the sealed portions 11 to 13 are formed after such stacking together.

Figures 3A, 3B:
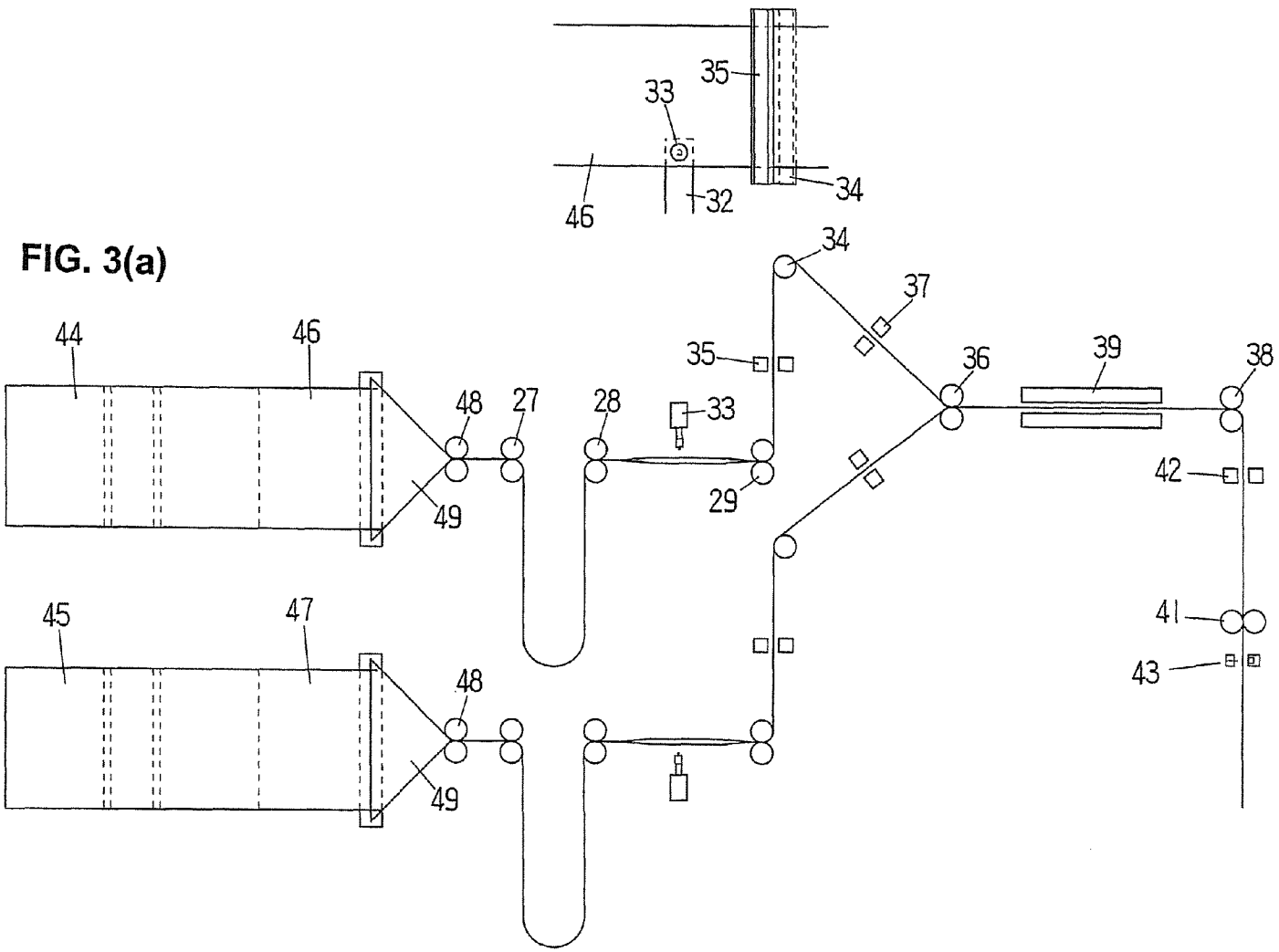
FIG. 3(*a*) is a schematic side elevational view of another overall manufacturing method of the bag with a gas filling compartment, and FIG. 3(*b*) being a top view of a part thereof.

Another example of the manufacturing method of the bag 1 is shown in FIGS. 3(*a*) and 3(*b*). In FIGS. 3(*a*) and 3(*b*), the same symbols are used to designate parts that are substantially the same as in FIGS. 2(*a*) and 2(*b*).

On two source rolls 44 and 45 are wound single-ply films 46 and 47, respectively. The films 46 and 47 are paid out continuously by feed rollers 27 and, from guide rollers 28 on, are conveyed intermittently, one bag-length at a time, during which time they are successively subjected to such operations as the following:

(1) First of all, the films are folded double in the longitudinal direction. On the film 46 side, a triangular plate 49 is set, as film double-folding means, between the source roll 44 and the guide rollers 48. The film 47 also is folded double in the same way.

(2) Cut-ins 18 and 19 are formed in the surfaces that are to become the films 6 and 7 of the outer bag 3. On the film 46 side, between the guide rollers 28 and 29, a backing member 32 is inserted and positioned between the upper and lower films, so that a punch 33 disposed above advances and retracts relative to that backing member 32, thus forming the cut-in 18. On the film 47 side, the same operation is performed with inverted symmetry, and the cut-in 19 is formed.

(3) The operations from there on are the same as in the method shown in FIGS. 2(*a*) and 2(*b*).

Figures 4A, 4B:
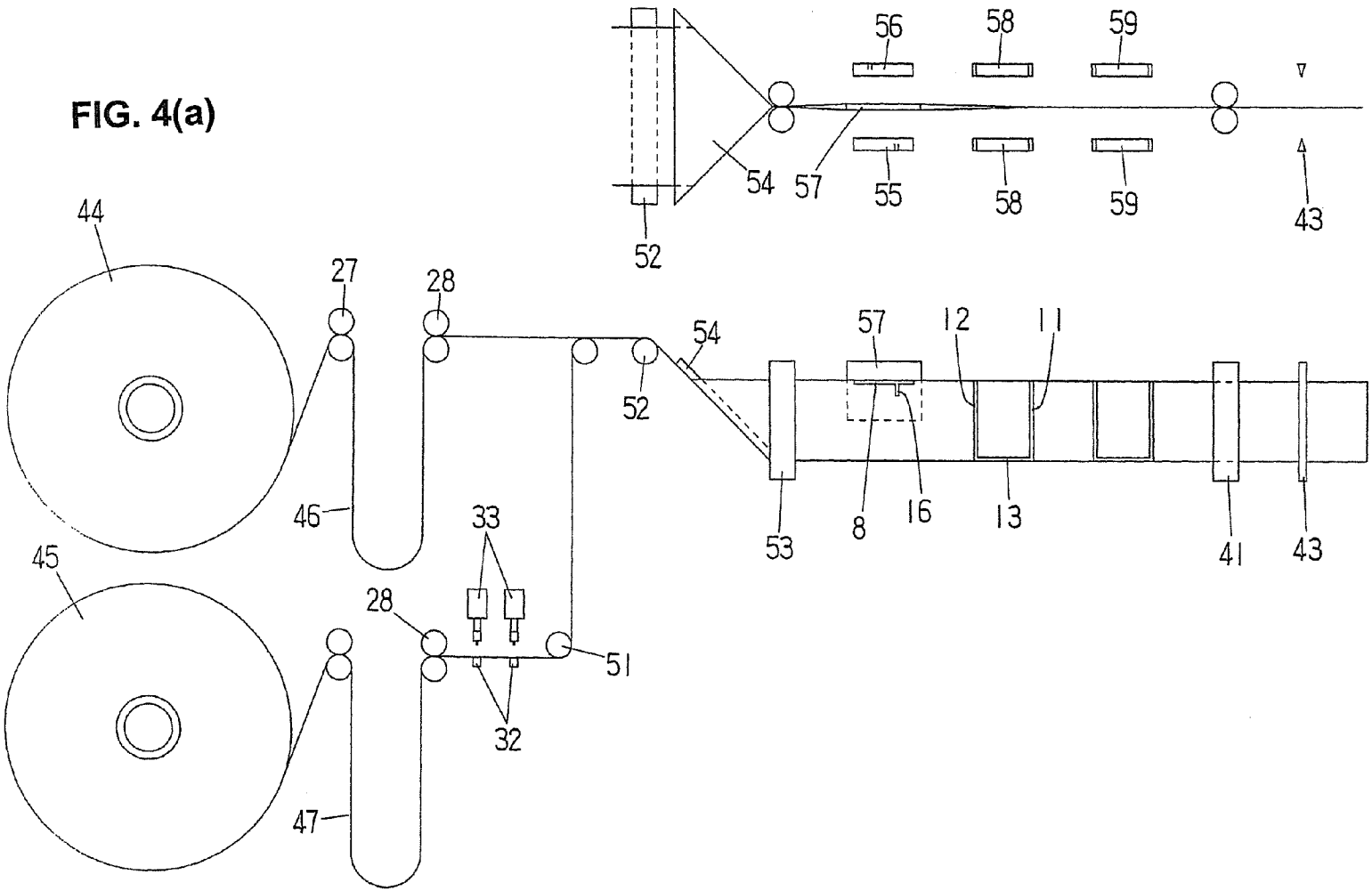
FIG. 4(*a*) is a schematic side elevational view of still another overall manufacturing method of the bag with a gas filling compartment, and FIG. 4(*b*) being a top view of a part thereof.
Figure 5A:
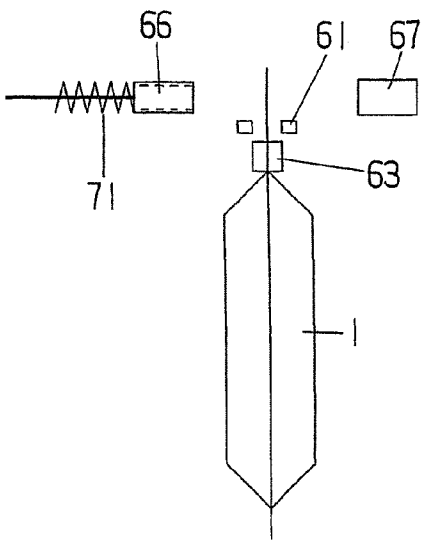
FIGS. 5(*a*) through 5(*d*) shows the steps of a gas seal-in method and packaging method of the present invention for the bag with a gas filling compartment.
Figure 5B:
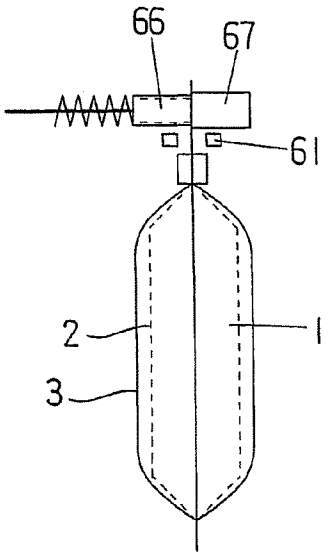
Figure 5C:
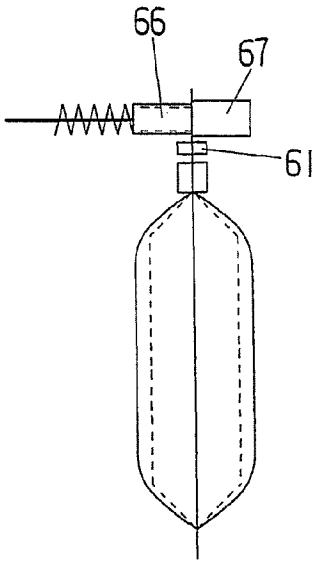
Figure 5D:
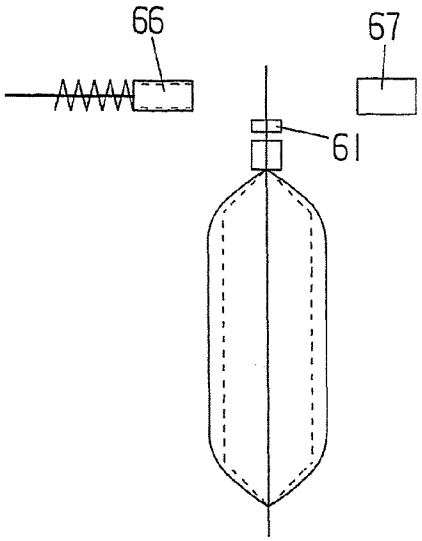

Yet another example of the manufacturing method of the bag 1 is shown in FIGS. 4(*a*) and 4(*b*). In FIGS. 4(*a*) and 4(*b*), the same symbols are used to designate parts that are substantially the same as in FIGS. 3(*a*) and 3(*b*).

On two source rolls 44 and 45 are wound single-ply films 46 and 47, respectively. The films 46 and 47 are paid out continuously by feed rollers 27 and, from guide rollers 28 on, are conveyed intermittently, one bag-length at a time, during which time they are successively subjected to such operations as the following:

(1) Cut-ins 18 and 19 and formed at two locations in the film 47 (films that become the films 6 and 7 in the outer bag 3). Pairs of punches 33 and backing members 32 are set between the guide rollers 28 and 51, the punches 33 advance and retract relative to the backing members 32, and cut-ins 18 and 19 are formed at two locations, diagonally across from each other, in the vicinities of the left and right edges of the film 47. These formation locations are positions corresponding to the upper edge side corner vicinities on mutually opposite sides of the films 6 and 7 of the outer bag 3 of the bag with a gas filling compartment 1, as shown in FIGS. 1(*a*) through 1(*c*).

(2) The films 46 and 47 are stacked together, folded double in the longitudinal direction to make a four-ply stack, such that the film 47 is on the outside and the film 46 is on the inside. A triangular plate 54 is set, as film double-folding means, between a guide roller 52 and guide rollers 53.

(3) On the opening (bag mouth) side of the four-ply stacked films, the outside films and the inside films are sealed together, on respective either side thereof (more specifically, the outside film and the inside film on one side of the four-ply stack are sealed together, and the outside film and the inside film on another side of the four-ply stack are also sealed together), forming the upper edge sealed portions 8 and 9 and the supplemental sealed portions 16 and 17. A sealing mechanism (only its pair of hot plates 55 and 56 and a hot plate backing plate 57 inserted and positioned, corresponding to the hot plates 55 and 56, between the inside films are shown) is set between the guide rollers 53 and guide rollers 41. The hot plates 55 and 56 advance and retract relative to the hot plate backing plate 57, the respectively adjacent inside films and outside films are held by the hot plates 55 and 56 and the hot plate backing plate 57 (with the two plies on the right side facing the downstream ends of the four-ply stacked films being held by the hot plate 55 and the hot plate backing plate 57, and the two plies on the left side facing the downstream ends of the four-ply stacked films being held by the hot plate 56 and the hot plate backing plate 57), and thereby the upper edge sealed portions 8 and 9 and the supplemental sealed portions 16 and 17 are formed simultaneously.

(4) The four-ply stacked films are sealed and the sealed portions 11 to 13 at the two lateral side edges and at the lower edge respectively are formed. A sealing mechanism (only its pair of hot plates 58 thereof is shown) is set between the guide rollers 53 and guide rollers 41 and on the downstream side of the hot plate 55 and other parts, the hot plates 58 advance and retract relative to the four-ply stacked films, and the four-ply stacked films are held together.

(5) The sealed portions 11 to 13 at the two lateral side edges and lower edge are cooled. A seal cooling mechanism (indicated only by a pair of cooling plates 59) is set between the guide rollers 53 and the guide rollers 41, on the downstream side of the hot plates 58, the cooling plates 59 advance and retract relative to the four-ply stacked films, and hold and cool the locations sealed by the hot plates 58.

(6) The operations from there on are the same as in the method shown in FIGS. 3(*a*) and 3(*b*).

In the embodiments described above, the sealed portions 8 and 9 and the supplemental sealed portions 16 and 17 are formed in a one-time operation, but the supplemental sealed portions 16 and 17 can be formed after the sealed portions 8 and 9 are formed, or, alternatively, the sealed portions 8 and 9 can also be formed after the supplemental sealed portions 16 and 17 are formed. Moreover, the sealed portions 11 to 13 are formed in a one-time operation, but the sealed portion 13 can be formed after the sealed portions 11 and 12 are formed, or, alternatively, the sealed portions 11 and 12 can also be formed after the sealed portion 13 is formed.

In the embodiments described above, moreover, the sealed portions 8 and 9 and the supplemental sealed portions 16 and 17 are formed after folding the two stacked-together films 46 and 47 to make a four-ply stack, but the upper edge sealed portions and supplemental sealed portions may also be formed one at a time on the left and right sides of the two films 46 and 47, to make a total of two, after stacking the two films 46 and 47 together but before folding them double in the longitudinal direction to make a four-ply stack.

Next, a method for manufacturing a product bag with a gas filling compartment with, for instance, a rotary type packaging apparatus using the bag with a gas filling compartment 1 show in FIGS. 1(*a*) through 1(*c*) is described with reference to FIGS. 5 to 7.

In a rotary type packaging apparatus, in general, a plural number of pairs of grippers is set at equal intervals about the periphery of a table that turns intermittently, bags are supplied to the grippers, the edges at the two sides of the bags are gripped by the grippers, held suspended, and then moved along intermittently; and various packaging processes such as opening the bag mouths, filling the bags with the contents to be packaged, and sealing the bag mouths are successively performed at each stop position. When the bag with a gas filling compartment 1 is used, auxiliary grippers (blocking grippers) for gripping prescribed places on the bag 1 from both sides of the bag are set in correspondence with the grippers in that type of rotary type packaging apparatus. The rotary type packaging apparatus used in the present invention differs on that point from the common rotary type packaging apparatus.

Figure 7A:
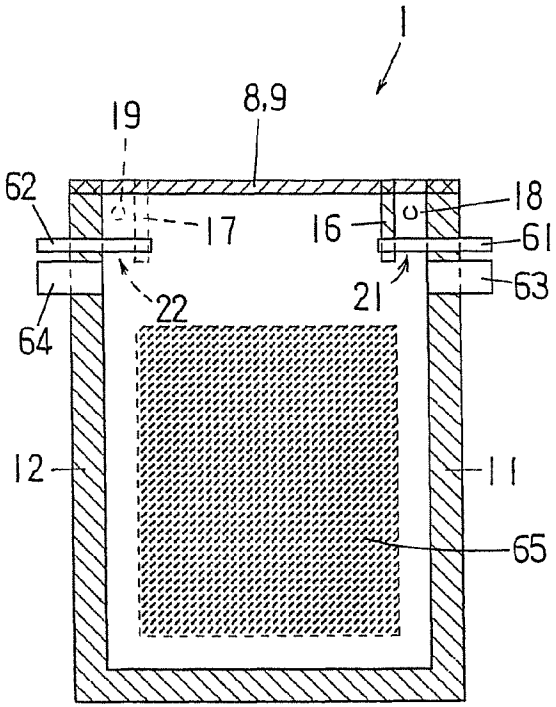
FIGS. 7(*a*) through 7(*c*) are front elevational views, respectively, of the filling step position for the contents to be packaged, the gas filling step position, and the bag mouth sealing step position in the gas seal-in method and packaging method.
Figure 7B:
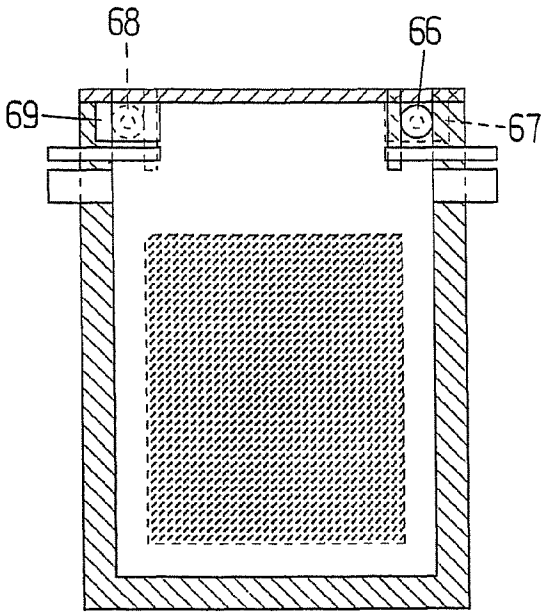
Figure 7C:
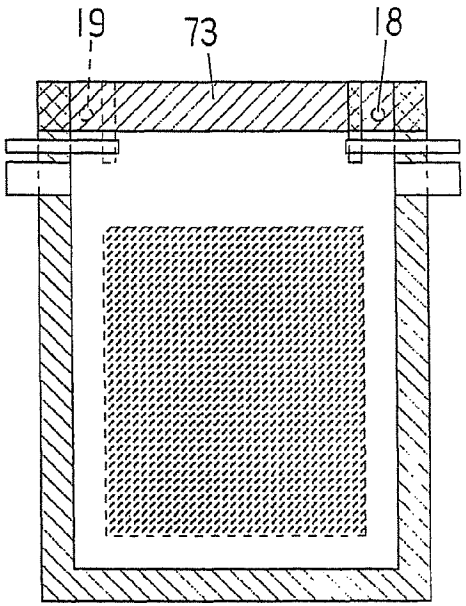

Auxiliary grippers 61 and 62 are, as shown in FIG. 7(*a*), set horizontal in the length dimension at positions directly above grippers 63 and 64, respectively, each of which is capable of opening and closing so as to be able to hold the bag 1 from both sides of the bag. FIG. 7(*a*) is a front elevational view at the position of the filling process for filling contents to be packaged 65 inside the inner bag 2 of the bag 1 (after filling). At this point in time, neither of the auxiliary grippers 61 and 62 are closed, but, as may be understood from this figure, when the auxiliary gripper 61 is closed, the bag is held so as to bridge across the bag surfaces below the cut-in 18, from the sealed portion 11 to the supplemental sealed portion 16, closing the gas flow path 21, and when the auxiliary gripper 62 is closed, the bag is held so as to bridge across the bag surfaces below the cut-in 19, from the sealed portion 12 to the supplemental sealed portion 17, closing the gas flow path 22.

In this packaging method, the known operations are performed up to the filling of the contents to be packaged. From the contents to be packaged filling process on, the gas sealing-in process (comprising a gas filling process and a cut-in sealing process) of the present invention is conducted as follows:

(1) After the filling of the contents to be packaged 65 (see FIG. 7(*a*)), the table of the rotary type packaging apparatus is turned; and, as shown in FIG. 5(*a*), the grippers 63 and 64 gripping the two edges of the bag 1 stop at the next stop position (gas filling process position). At this stop position, a blow-in nozzle 66 connected to a pressurized air (gas) supply source through a switchover valve (not shown in the drawings) is set so as to be positioned just in front of the cut-in 18 formed in the bag 1, and, so as to sandwich the bag 1, a backing member 67 facing the blow-in nozzle 66 is set on the opposite side. Also, although not shown in FIG. 5(*a*), as shown in FIG. 7(*b*), another set of a blow-in nozzle 68 and backing member 69 is set at this stop position, facing in the same way, in correspondence with the cut-in 19. The blow-in nozzles 66 and 68 are energized in the forward direction by a compression spring 71.

Figure 8:
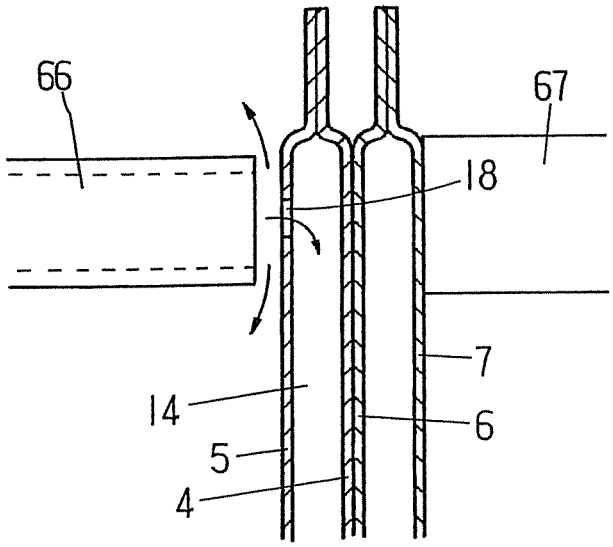
FIG. 8 illustrates how the gas filling is done by an air (gas) blow-in nozzle.

(2) As seen from FIG. 5(*b*), the blow-in nozzle 66 and the backing member 67 advance together, a blow-in port at the tip of the blow-in nozzle 66 contacts the bag surface at the periphery of the cut-in 18, the back side thereof is held by the backing member 67, and, simultaneously, pressurized air (gas) is blown out from the tip of the blow-in nozzle 66. When air (gas) blow-out starts, due to that air (gas) pressure, the blow-in nozzle 66 moves back slightly against the energizing force of the compression spring 71, as a consequence whereof, as shown in FIG. 8, a gap develops between the films 4 and 6 configuring the gas filling compartment 14, air (gas) is blown through the cut-in 18 into the gas filling compartment 14, and the gas filling compartment 14 distends. Simultaneously, on the gas filling compartment 15 side also, due to the blow-in nozzle 68 and the backing member 69, air (gas) blow-in is conducted through the cut-in 19. Furthermore, the blow-in gas may be a gas other than air.

(3) As shown in FIG. 5(*c*), the auxiliary grippers 61 and 62 close, holding the bag surfaces from both sides of the bag, so that the gas flow paths 21 and 22 are cut off, and the gas inside the gas filling compartments 14 and 15 is prevented from escaping to the outside through the cut-ins 18 and 19. Then the air (gas) blow-out from the blow-in nozzles 66 and 68 (air blow-in into the gas filling compartment 14) is stopped.

(4) As shown in FIG. 5(*d*), the blow-in nozzles 66 and 68 and the backing members 67 and 69 move back away from the bag surfaces. Thereupon, the gas filling process ends.

(5) Following this, the table of the rotary type packaging apparatus turns, and the grippers 63 and 64 gripping the two edges of the bag 1 stop at the next stop position (bag mouth sealing process position). At this stop position, the bag mouth sealing operation is performed, functioning also as a cut-in sealing process. At this stop position, as shown in FIG. 6(*e*), a sealing mechanism (indicated only by the hot plates 72) for the bag mouth is set. The hot plates 72 have a width in the height direction capable of covering the cut-ins 18 and 19. When they are closed, as shown in FIG. 6(*f*), they seal all of the films 4 to 7 at the bag mouth, tightly sealing the contents to be packaged inside the bag 1, and, simultaneously, they also seal and close together the films 4 to 7 at the locations of the cut-ins 18 and 19, sealing the gas inside the gas filling compartments 14 and 15. The sealed portion 73 at the bag mouth, sealed by the hot plates 72, is shown in FIG. 7(*c*). In this manner, the locations of the cut-ins 18 and 19 are also sealed together.

Figure 6G:
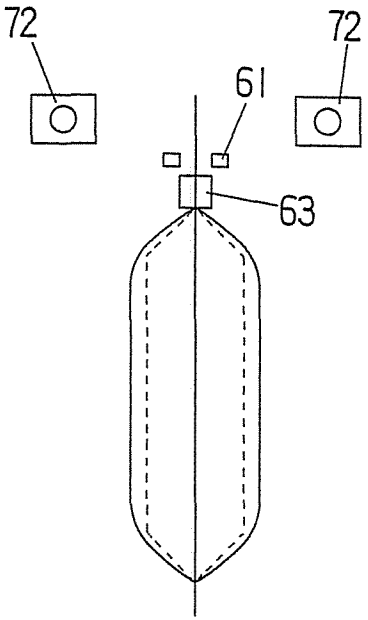
FIGS. 6(*e*) through 6(*g*) show the step continuing from the step of FIG. 5(*d*)
Figure 6F:
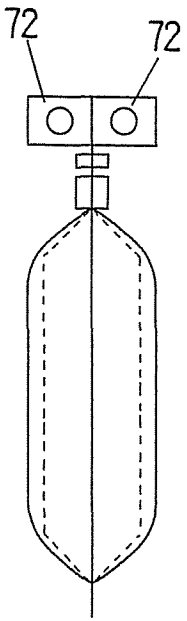
Figure 6E:
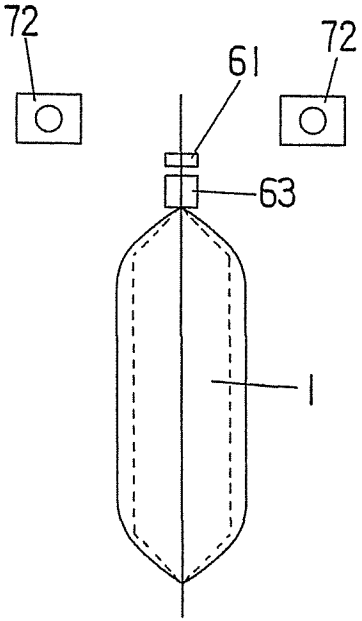

(6) As shown in FIG. 6(*g*), the hot plates 72 and the auxiliary grippers 61 and 62 open, and, thereby, a product of bag with a gas filling compartment is finished.

(7) Following that, the table of the rotary type packaging apparatus is turned, and the grippers 63 and 64 gripping the two edges of the bag 1 move to the next stop position (cooling and discharge position), where, by a commonly known method, the bag mouth is held and cooled by cooling plates, the grippers 63 and 64 open during the cooling, and then the cooling plates open, and the product of bag with gas filling compartment is released and discharged.

The cut-ins 18 and 19 formed in the films 6 and 7 of the outer bag 3 are cut lines having no planar size, which themselves have no planar size. Ordinarily they are in a substantially closed condition, but open due to air (gas) pressure when air (gas) is blown in; and when the bag surfaces are held by the auxiliary grippers 61 and 62 and the gas flow paths 21 and 22 are cut off, and the blow-in nozzles 66 and 68 have moved back, they return to the closed condition. Also, when the bag mouth is heat-sealed, the film 6 of the outer bag 3 wherein the cut-in 18 is formed is sealed with the film 4 of the inner bag 2, and the film 7 of the outer bag 3 where the cut-in 19 is formed is sealed with the film 5 of the inner bag 2 (the films 4 and 5 of the inner bag 2 also being sealed together). However, at that time, the films 6 and 7 of the outer bag 3 are sealed with the films 4 and 5 of the inner bag; accordingly, the condition becomes one wherewith, by outward appearance, the cut-ins 18 and 19 are substantially non-existent.

A hole can be formed instead of the cut-ins 18 and 19; however, as described in Japanese Patent Application Laid-Open (Kokai) No. H11-227803, when a hole is made (which forms a means for introducing gas), the melted sealant material (film) adheres to the sealing hot plates, and overruns from the hole to the periphery; accordingly, a cut-in capable of preventing such a problem is preferable.

Figure 9B:
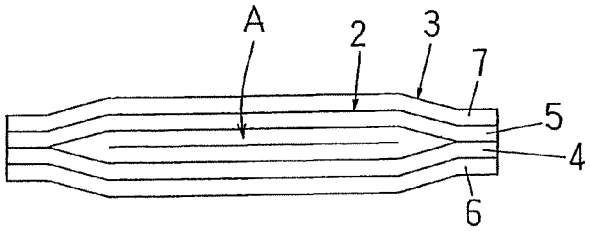
FIG. 9(*a*) is a schematic front elevational view of another bag having a gas filling compartment according to the present invention, FIG. 9(*b*) being a top view thereof, and FIG. 9(*c*) being a sectional view thereof.
Figure 9A:
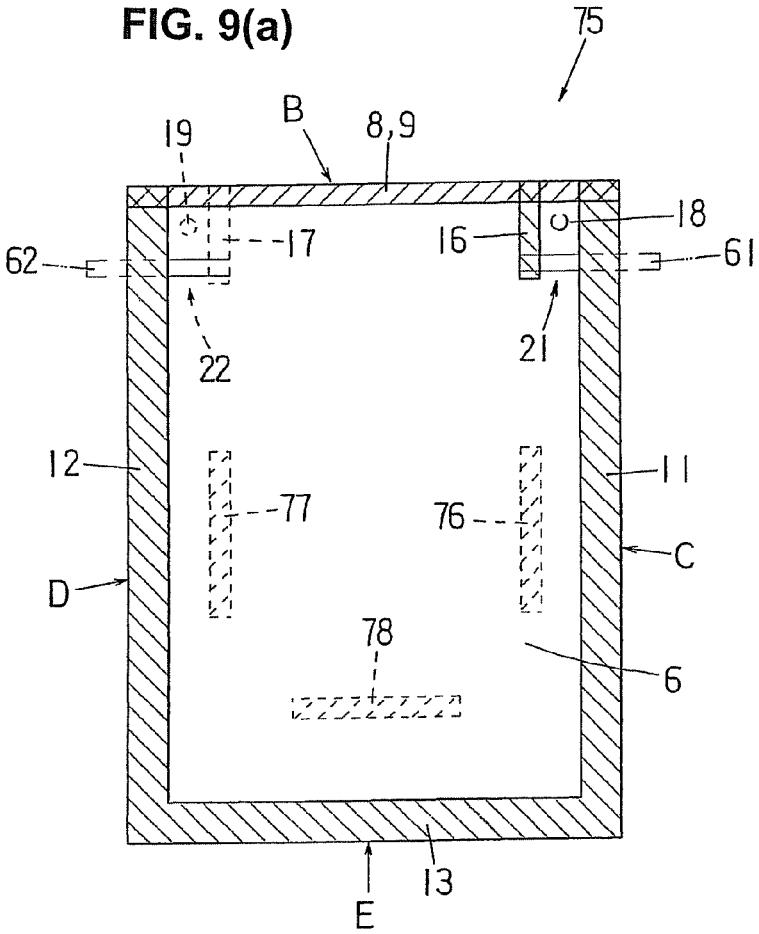
Figure 9C:
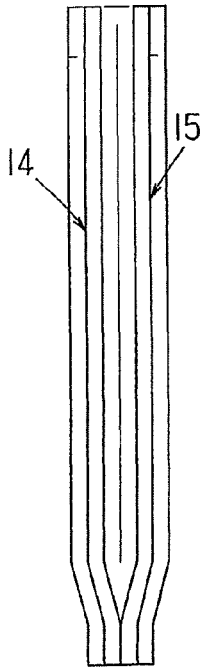

FIGS. 9(*a*) through 9(*c*) show a bag with a gas filling compartment 75 of another embodiment of the present invention. In FIGS. 9(*a*) through 9(*c*), the same symbols are used to designate parts that are substantially the same as in FIGS. 1(*a*) through 1(*c*).

The bag 75 differs from the bag 1 shown in FIGS. 1(*a*) through 1(*c*) only in that the films 4 and 5 of the inner bag 2 are sealed together at a plurality of locations. These sealed portions function to position the contents packaged at substantially determined positions inside the inner bag 2. More specifically, sealed portions 76 and 77 are formed with left and right symmetry in the longitudinal direction slightly more to the inside, in the width direction, than the sealed portions 11 and 12 at the two lateral side edges, and a sealed portion 78 is formed in the lateral direction slightly more to the inside, in the height direction, than the lower edge sealed portion 13 With these sealed portions 76 to 78, the contents storing position in the inner bag 2 is deliminated to substantially the central area thereof, so that the contents packaged will be positioned in substantially the central area of the inner bag 2.

In FIGS. 9(*a*) through 9(*c*), the holding positions of the auxiliary grippers 61 and 62 are indicated by imaginary lines. The seals for the cut-ins 18 and 19 may be made together with the bag mouth seal as in the bag 1.

Figure 10B:
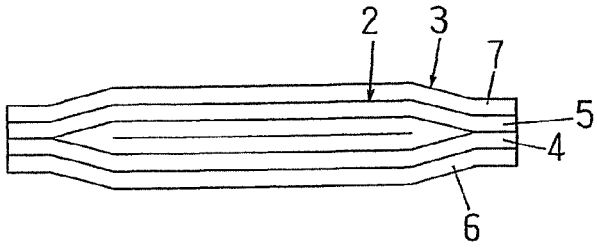
FIG. 10(*a*) is a schematic front elevational view of still another bag having a gas filling compartment according to the present invention, FIG. 10(*b*) being a top view thereof, and FIG. 10(*c*) being a sectional view thereof.
Figure 10A:
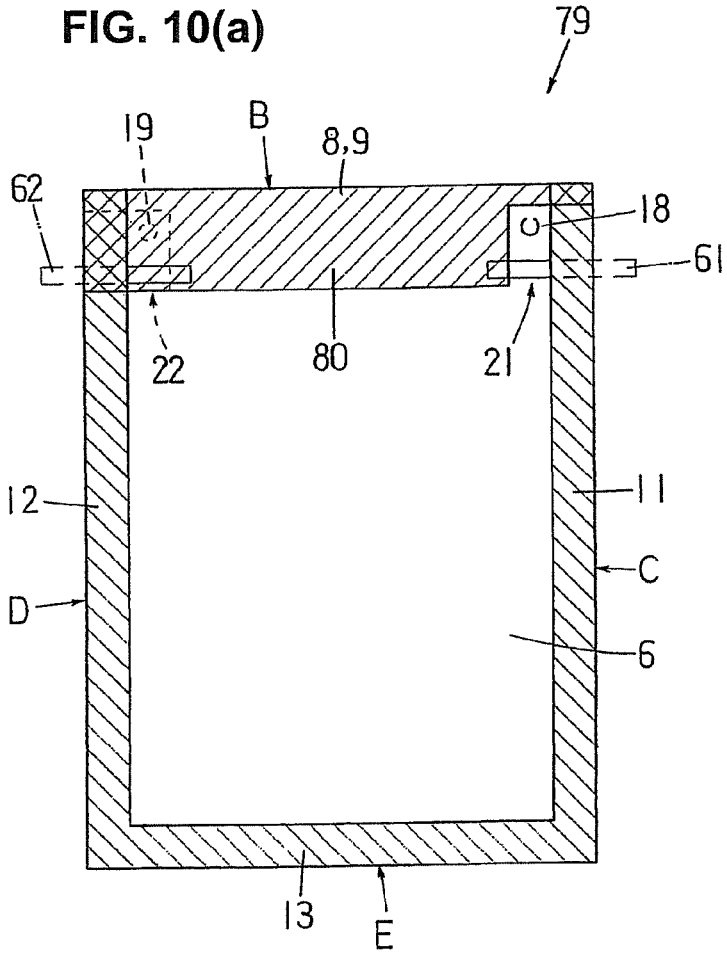
Figure 10C:
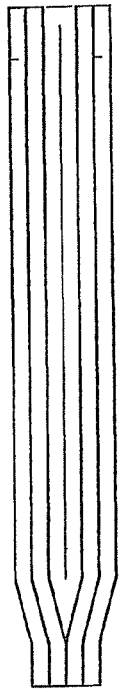

FIGS. 10(*a*) through 10(*c*) show a bag with a gas filling compartment 79 of still another embodiment of the present invention. In FIGS. 10(*a*) through 10(*c*) as well, the same symbols are used to designate parts that are substantially the same as in FIGS. 1(*a*) through 1(*c*).

In the bag 79, a supplemental sealed portion 80, where the film 6 of the outer bag 3 and the film 4 of the inner bag 2 are sealed, is formed continuously with the sealed portion 8 along the upper edge and the sealed portion 12 at the lateral side edge. On the back surface also, a supplemental sealed portion (reference symbol omitted) where the film 7 of the outer bag 3 and the film 5 of the inner bag 2 are sealed is formed continuously with the sealed portion 9 along the upper edge and the sealed portion 11 at the lateral side edge. The bag 79 differs from the bag 1 only in the form of this supplemental sealed portion 80 (and of the other supplemental sealed portion) and is the same otherwise as the bag 1. The supplemental sealed portion 80 (and the other supplemental sealed portion) of the bag 79 have the same functions as the supplemental sealed portions 16 and 17 of the bag 1.

In FIGS. 10(*a*) through 10(*c*), moreover, the holding positions of the auxiliary grippers 61 and 62 are indicated by imaginary lines. The seals for the cut-ins 18 and 19 may be made together with the bag mouth seal as in the bag 1.

Figure 11B:
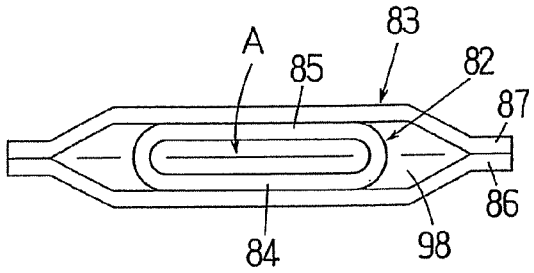
FIG. 11(*a*) is a schematic front elevational view of still another bag having a gas filling compartment according to the present invention, FIG. 11(*b*) being a top view thereof, and FIG. 11(*c*) being a sectional view thereof.
Figure 11A:
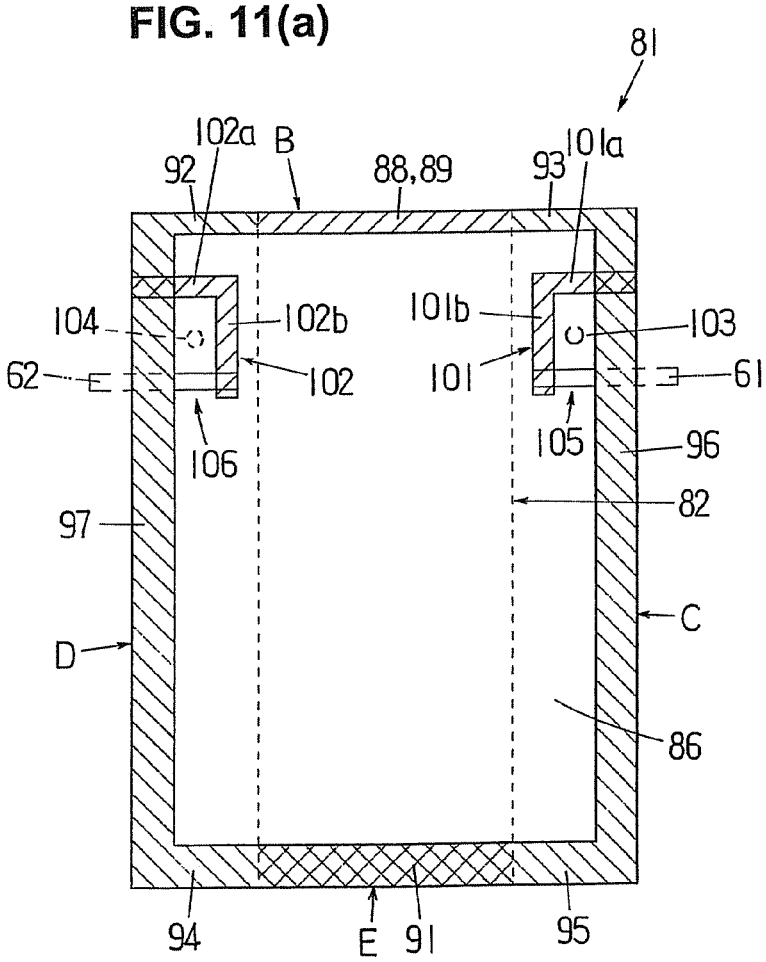
Figure 11C:
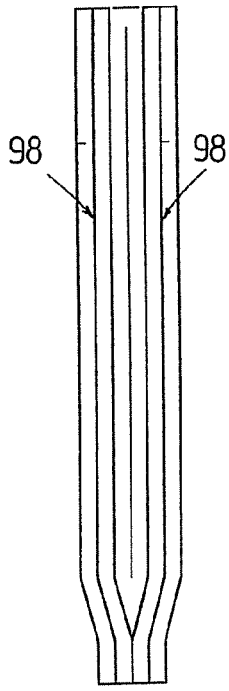

FIGS. 11(*a*) through 11(*c*) show a bag with a gas filling compartment 81 of still another embodiment of the present invention.

The bag 81 comprises a tubular inner bag 82 and an outer bag 83 having a greater width than the inner bag 82, with the inner bag 82 being inside the outer bag 83. The bag mouth A of the inner bag 82 is open; and, along the upper edge B of the bag 81, the films 84 and 85 of the inner bag 82 and the films 86 and 87 of the outer bag 83 are sealed together on each side of the respective bags (in other words, the adjacent film 84 of the inner bag 82 and film 86 of the outer bag 83 both on one side are sealed together to form a sealed portion 88, and the adjacent film 85 of the inner bag 82 and film 87 of the outer bag 83 both on another side are also sealed together to form a sealed portion 89). The sealed portions 88 and 89 are indicated by crosshatching in FIG. 11(*a*). Along the lower edge E of the bag 81, the films 84 and 85 of the inner bag 82 and the films 86 and 87 of the outer bag 83 are sealed together to form a sealed portion 91. This sealed portion 91 is indicated, similarly, by double crosshatching in FIG. 11(*a*). Furthermore, at portions on the two sides of the inner bag 82 along the upper edge B and lower edge E of the bag 81 and at portions along the two lateral side edges C and D, the films 86 and 87 of the outer bag 83 are sealed together. The sealed portions 92 to 97 are indicated, similarly, by crosshatching in FIG. 11(*a*).

By these sealed portions 88, 89, and 91 to 97, a gas filling compartment 98 is formed between the inner bag 82 and the outer bag 83. In FIG. 11(*b*), it appears that two gas filling compartments are provided separately left and right. However, because the inner bag 82 and the outer bag 83 are not sealed except along the upper edge and lower edge, the left and right gas filling compartments are continuous to form a single gas filling compartment.

In the vicinities of the upper edge side corners of the bag 81, supplemental sealed portions 101 and 102, where the films 86 and 87 of the outer bag 83 are sealed together, in like manner as the sealed portions 96 and 97, are formed, in mutual symmetry, in angled or hooked shapes, continuously with the sealed portions 96 and 97. The supplemental sealed portions 101 and 102 respectively comprise lateral portions 101*a* and 102*a*, which are continuous to the sealed portions 96 and 97, and longitudinal parts 101*b* and 102*b*, which are continuous to the ends thereof.

Also, at a position surrounded by the supplemental sealed portion 101 and the sealed portion 96 and a position surrounded by the supplemental sealed portion 102 and the sealed portion 97, circular arc-shaped cut-ins 103 and 104 for gas blow-in are formed, respectively, in the surfaces of the films 86 and 87 of the outer bag 83. In other words, the cut-in 103 has the vicinity thereof surrounded at the top and on the inside in the width direction by the supplemental sealed portion 101 and on the outside in the width direction by the sealed portion 96, while the other cut-in 104 has the vicinity thereof surrounded at the top and on the inside in the width direction by the supplemental sealed portion 102 and on the outside in the width direction by the sealed portion 97, leaving unsealed parts only downward, respectively, and thus forming gas flow paths 105 and 106 that communicate with the gas filling compartment 98. Accordingly, the gas blown inside the bag 81 from the cut-ins 103 and 104 passes through the gas flow paths 105 and 106 and enters inside the gas filling compartment 98.

To this bag 81, as in the bag 1, the gas seal-in and packaging methods described thus far can be applied. In FIG. 11(*a*), the holding positions of the auxiliary grippers 61 and 62 are shown by imaginary lines. The seals for the cut-ins 103 and 104 may be made together with the bag mouth seal as in the bag 1.

In the embodiments described above, all of the cut-ins are formed in the vicinity of the upper edge of the bag, and the seals thereof are made together with the bag mouth seal. However, the positions where the cut-ins are formed are not limited to the vicinity of the upper edge of the bag, and the cut-ins can also be formed at other locations. Alternatively, the cut-ins and the sealing about the peripheries thereof can also be made independently of the bag mouth sealing. However, when the cut-ins are formed in the vicinity of the upper edge of the bag, the advantage is that the bag mouth sealing process can be effected so that cut-in sealing is done at the same time. Also, all of the cut-ins in the above embodiments are formed in the vicinity of the lateral side edges of the bag, because that facilitates holding the gas flow paths by the auxiliary grippers from the sides of the bag. In other words, it is preferable that the cut-ins be formed in the vicinity of the upper edge side corners of the bag.

In the embodiments described above, only one supplemental sealed portion is formed for each cut-in or hole, but two or more supplemental sealed portions can be formed for each cut-in or hole and thereby the cut-ins or holes surrounded.

The invention claimed is:

1. A method for sealing-in a gas in a bag with a gas filling compartment, said bag comprising an outer bag and an inner bag which is provided inside of the outer bag, wherein the inner bag has an opening along an upper edge thereof;

films of the inner bag and films of the outer bag are sealed together, on each side of respective bags, along upper edges thereof, and further both lateral side edges and lower edges of the films of the inner bag and the films of the outer bag are sealed together, thus forming gas filling compartments between the films of the inner bag and the films of the outer bag;

means for introducing gas in the gas filling compartments are formed in the respective films of the outer bag; and the films of the outer bag and the films of the inner bag are sealed together in the vicinity of said means for introducing gas, and sealed portions thereof surround peripheries of said means for introducing gas, leaving gas flow paths communicating to insides of said gas filling compartments; and said method comprising the steps of:

placing a blow-out port of a nozzle, which is connected to a pressurized gas supply source, against said means for introducing gas and holding a back surface side of said bag with a backing member;

blowing a gas from said nozzle into an inside of the gas filling compartment through said means for introducing gas;

gripping and thus closing the gas flow path in the sealed portions surrounding a periphery of said means for introducing gas by a blocking gripper while the gas blow-in continues, thus cutting off a flow of gas between said means for introducing gas and an inside of the gas filling compartment; and sealing said means for introducing gas, thus allowing said gas to be sealed in the gas filling compartment.

2. The method for sealing-in a gas in a bag with a gas filling compartment according to claim 1, wherein said sealing of said means for introducing gas is effected by sealing two surfaces of said bag at a location of said means for introducing gas.

3. The method for sealing-in a gas in a bag with a gas filling compartment according to claim 1, wherein a supplemental sealed portion is formed by sealing the films of the outer bag and the films of the inner bag; and said supplemental sealed portion and an upper edge sealed portion and/or one of lateral side edge sealed portions form said sealed portions that surround the periphery of said means for introducing gas.

4. The method for sealing-in a gas in a bag with a gas filling compartment according to claim 3, wherein said supplemental sealed portion is formed to be continuous to the upper edge sealed portion and/or one of the lateral side edge sealed portions.

5. The method for sealing-in a gas in a bag with a gas filling compartment according to claim 3, wherein said supplemental sealed portions are formed in said bag by mutually sealing a part of the films of the outer bag and a part of the films of the inner bag on each side of respective bags.

6. The method for sealing-in a gas in a bag with a gas filling compartment according to claim 5, wherein said means for introducing gas are formed respectively in the films of the outer bag so as to be located in the vicinity of upper edge side corners on mutually opposite lateral side edges.

7. The method for sealing-in a gas in a bag with a gas filling compartment according to claim 1, wherein said means for introducing gas are formed respectively in the films of the outer bag so as to be located in the vicinity of upper edge side corners on mutually opposite lateral side edges.

8. A method for sealing-in a gas in a bag with a gas filling compartment, said bag comprising an outer bag and an inner bag which is provided inside of and is smaller in width than the outer bag, wherein the inner bag has an opening along an upper edge thereof;

films of the inner bag and films of the outer bag are sealed together, on each side of respective bags, along upper edges thereof, the films of the inner bag and the films of the outer bags are sealed together along lower edges thereof, and further the films of the outer bag are sealed together at upper and lower edges thereof on both lateral sides of the inner bag and along both lateral side edges thereof, thus forming a gas filling compartment between the films of the inner bag and outer bag;

a means for introducing gas is formed in at least one side of the outer bag; and the films of the outer bag are sealed together in the vicinity of said means for introducing gas, and sealed portions thereof surround a periphery of said means for introducing gas, leaving a gas flow path communicating to inside of said gas filling compartment, and said method comprising the steps of:

placing a blow-out port of a nozzle, which is connected to a pressurized gas supply source, against said means for introducing gas and holding a back surface side of said bag with a backing member;

blowing a gas from said nozzle into an inside of the gas filling compartment through said means for introducing gas;

gripping and thus closing the gas flow path in the sealed portions surrounding a periphery of said means for introducing gas by a blocking gripper while the gas blow-in continues, thus cutting off a flow of gas between said means for introducing gas and an inside of the gas filling compartment; and sealing said means for introducing gas, thus allowing said gas to be sealed in the gas filling compartment.

9. The method for sealing-in a gas in a bag with a gas filling compartment according to claim 8, wherein a supplemental sealed portion is formed by sealing a part of the films of the outer bag; and said supplemental sealed portion and one of upper edge sealed portions formed by films of the outer bag and/or one of lateral side edge sealed portions of the outer bag form said sealed portions that surround the periphery of said means for introducing gas.

10. The method for sealing-in a gas in a bag with a gas filling compartment according to claim 9, wherein said supplemental sealed portion is formed so as to be continuous to upper edge sealed portion or one of the lateral side edge sealed portions.

11. The method for sealing-in a gas in a bag with a gas filling compartment according to claim 8, wherein said means for introducing gas formed in the films of the outer bag are located in the vicinity of upper edge side corners.

12. The method for sealing-in a gas in a bag with a gas filling compartment according to any one of claims 3 through 11, wherein said sealing of said means for introducing gas is effected by sealing two surfaces of said bag at a location of said means for introducing gas.

13. A method for sealing-in a gas in a bag with a gas filling compartment, said bag comprising an outer bag and an inner bag which is provided inside of the outer bag, wherein the inner bag has an opening along an upper edge thereof;

films of the inner bag and films of the outer bag are sealed together, on each side of respective bags, along upper edges thereof, and further both lateral side edges and lower edges of the films of the inner bag and the films of the outer bag are sealed together, thus forming gas filling compartments between the films of the inner bag and the films of the outer bag;

means for introducing gas in the gas filling compartments are formed in the respective films of the outer bag, said means for introducing gas are formed respectively in the films of the outer bag so as to be located in the vicinity of upper edge side corners on mutually opposite lateral side edges; and the films of the outer bag and the films of the inner bag are sealed together in the vicinity of said means for introducing gas, and sealed portions thereof surround peripheries of said means for introducing gas, leaving gas flow paths communicating to insides of said gas filling compartments, and said method comprising the steps of:

placing a blow-out port of a nozzle, which is connected to a pressurized gas supply source, against said means for introducing gas and holding a back surface side of said bag with a backing member;

blowing a gas from said nozzle into an inside of the gas filling compartment through said means for introducing gas;

gripping and closing the gas flow path in the sealed portions surrounding a periphery of said means for introducing gas by a blocking gripper while the gas blow-in continues, thus cutting off a flow of gas between said means for introducing gas and an inside of the gas filling compartment; and sealing a bag mouth of said bag from both surfaces and said means for introducing gas, thus allowing said gas to be sealed in the gas filling compartment.

14. A method for sealing-in a gas in a bag with a gas filling compartment, said bag comprising an outer bag and an inner bag which is provided inside of the outer bag, wherein the inner bag has an opening along an upper edge thereof;

films of the inner bag and films of the outer bag are sealed together, on each side of respective bags, along upper edges thereof, and further both lateral side edges and lower edges of the films of the inner bag and the films of the outer bag are sealed together, thus forming gas filling compartments between the films of the inner bag and the films of the outer bag;

means for introducing gas in the gas filling compartments are formed in the respective films of the outer bag, said means for introducing gas being formed respectively in the films of the outer bag so as to be located in the vicinity of upper edge side corners on mutually opposite lateral side edges;

the films of the outer bag and the films of the inner bag are sealed together in the vicinity of said means for introducing gas, and sealed portions thereof surround peripheries of said means for introducing gas, leaving gas flow paths communicating to insides of said gas filling compartments;

a supplemental sealed portion is formed by sealing the films of the outer bag and the films of the inner bag;

said supplemental sealed portion and an upper edge sealed portion and/or one of lateral side edge sealed portions form said sealed portions that surround the periphery of said means for introducing gas;

said supplemental sealed portion is formed in said bag by mutually sealing a part of the films of the outer bag and a part of the films of the inner bag on each side of respective bags, and said method comprising the steps of:

placing a blow-out port of a nozzle, which is connected to a pressurized gas supply source, against said means for introducing gas and holding a back surface side of said bag with a backing member;

blowing a gas from said nozzle into an inside of the gas filling compartment through said means for introducing gas;

gripping and closing the gas flow path in the sealed portions surrounding a periphery of said means for introducing gas by a blocking gripper while the gas blow-in continues, thus cutting off a flow of gas between said means for introducing gas and an inside of the gas filling compartment; and sealing a bag mouth of said bag from both surfaces and said means for introducing gas, thus allowing said gas to be sealed in the gas filling compartment.

15. A method for sealing-in a gas in a bag with a gas filling compartment, said bag comprising an outer bag and an inner bag which is provided inside of and is smaller in width than the outer bag, wherein the inner bag has an opening along an upper edge thereof;

films of the inner bag and films of the outer bag are sealed together, on each side of respective bags, along upper edges thereof, the films of the inner bag and the films of the outer bags are sealed together along lower edges thereof, and further the films of the outer bag are sealed together at upper and lower edges thereof on both lateral sides of the inner bag and along both lateral side edges thereof, thus forming a gas filling compartment between the films of the inner bag and outer bag;

a means for introducing gas is formed in at least one side of the outer bag, said means for introducing gas being formed in the films of the outer bag are located in the vicinity of upper edge side corners; and the films of the outer bag are sealed together in the vicinity of said means for introducing gas, and sealed portions thereof surround a periphery of said means for introducing gas, leaving a gas flow path communicating to inside of said gas filling compartment, and said method comprising the steps of:

placing a blow-out port of a nozzle, which is connected to a pressurized gas supply source, against said means for introducing gas and holding a back surface side of said bag with a backing member;

blowing a gas from said nozzle into an inside of the gas filling compartment through said means for introducing gas;

gripping and closing the gas flow path in the sealed portions surrounding a periphery of said means for introducing gas by a blocking gripper while the gas blow-in continues, thus cutting off a flow of gas between said means for introducing gas and an inside of the gas filling compartment; and sealing a bag mouth of said bag from both surfaces and said means for introducing gas, thus allowing said gas to be sealed in the gas filling compartment.

* * * * *